US005756995A

United States Patent [19]

Maswadeh et al.

[11] Patent Number: 5,756,995

[45] Date of Patent: May 26, 1998

[54] ION INTERFACE FOR MASS SPECTROMETER

[75] Inventors: Waleed M. Maswadeh, Edgewood; A. Peter Snyder, Bel Air, both of Md.

[73] Assignee: The United States of America as represented by the Secretary of the Army, Washington, D.C.

[21] Appl. No.: 890,478

[22] Filed: Jul. 9, 1997

[51] Int. Cl.[6] ..... H01J 49/26

[52] U.S. Cl. ..... 250/288

[58] Field of Search ..... 250/288, 288 A, 250/281, 282

[56] References Cited

U.S. PATENT DOCUMENTS 5,376,789 12/1994 Stenhagen ..... 250/288

*Primary Examiner*—Kiet T. Nguyen

*Attorney, Agent, or Firm*—Ulysses John Biffoni

[57] ABSTRACT

A heated capillary tube is axially supported in center of a housing under vacuum. One end of the capillary tube receives ions from an ion source. The other end of the capillary tube terminates adjacent to the inner side of a flat plate having an orifice. A transport tube is connected to the outer side of the flat plate and has an open outer end. A first electrical field exists between the capillary tube and the plate to control the flow of ions. A second electrical field exists downstream of the plate, and the tube is disposed within the second electrical field. The transport tube allows for more efficient focusing of ions by the electrical and aerodynamic means to the mass spectrometer. A mechanical valve may be coupled to the capillary tube to independently control the flow of ions and the entire probe may be removed without compromising the vacuum in the mass spectrometer.

18 Claims, 2 Drawing Sheets

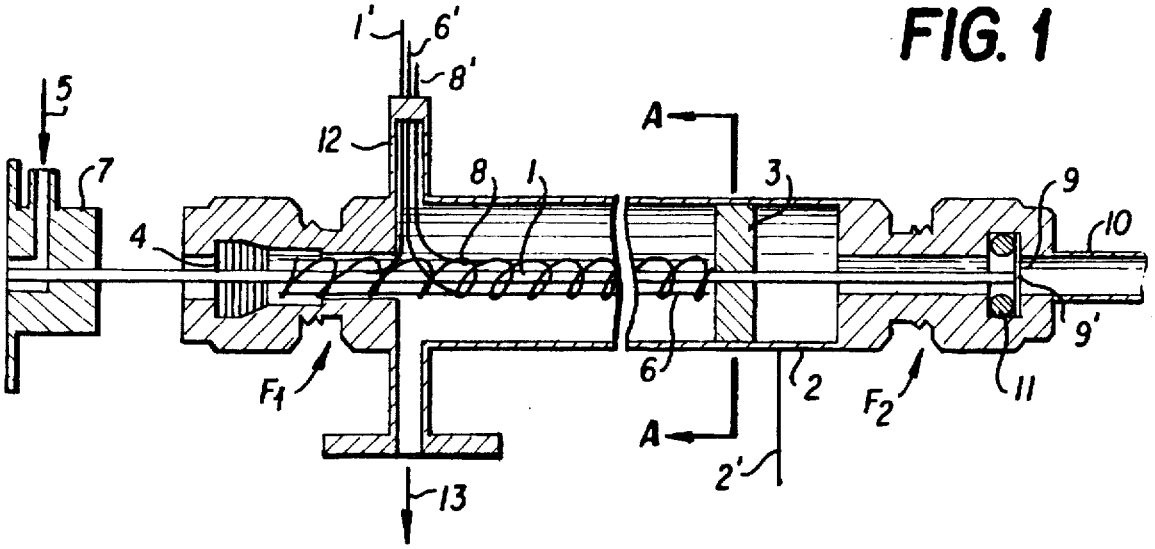
FIG. 1
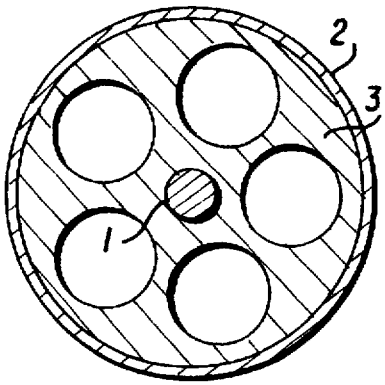
FIG. 1A
FIG. 2A
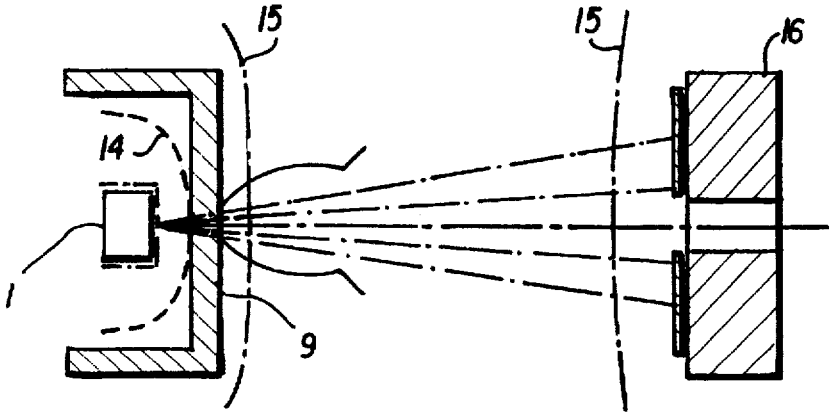

ION INTERFACE FOR MASS SPECTROMETER

FIELD OF INVENTION

The present invention is related to the fields of electrospray ionization (ESI) and mass spectrometry (MS). Specifically, the present invention is directed to an interface for transferring ions from an ion source at atmospheric pressure (ESI device) to a vacuum mass spectrometer (MS device).

BACKGROUND OF THE INVENTION

A common method for analyzing various biological and chemical compounds dissolved in a liquid involves introducing molecular ions from an ion source into various types of mass spectrometers (e.g., magnetic sector, linear quadrupole, hyperbolic-shaped quadrupole (ion trap), Fourier transform ion cyclotron resonance, and time-of-flight mass spectrometers). Typically, an ion source or ESI device consists of a metal capillary tube having an applied voltage of a few kilowatts. A liquid sample pumped into the capillary tube develops into charged liquid droplets which exit the capillary tube at atmospheric pressure. As charged liquid droplets fragment and evaporate, molecular ions having the same polarity from the applied potential migrate to the surface of the droplets, where Coulomb explosions cause the droplets to break up into yet smaller droplets. At certain diameters, molecular ions are desorbed from the droplets into the gas phase, forming gas-phase ions.

Conventional methodologies for assisting the transmission of ions and reducing the pressure difference between the output end of the ion source (at atmospheric pressure) and the entrance end of the mass spectrometer (at vacuum) include permanently placing an ion interface at the entrance end of the mass spectrometer. However, the conventional interface has numerous vacuum pumps and electronics which consume a high quantity of electric power (i.e., an average of 2300 watts) and occupy a large space. As a result, it is relatively large, bulky, and expensive. Additionally, because the conventional interface is permanently mounted on the mass spectrometer, the operation of the mass spectrometer is undesirably interrupted (e.g. termination of vacuum) whenever the conventional interface is serviced or replaced. Moreover, the prior art has primarily dealt with only the optimization of electric fields in order to efficiently focus and provide for ion transfer into a mass spectrometer (MS).

SUMMARY OF THE INVENTION

It is therefore an object of the present invention to overcome the problems discussed above and to provide a simple, inexpensive, and detachable ion interface.

In accordance with the present invention, there is provided an ion interface comprising: a capillary tube having a first open end for receiving ions and a second open end for discharging ions downstream of the capillary tube; an air-tight housing surrounding a portion of the capillary tube; supporting means for supporting the capillary tube within the housing; means for producing a vacuum within the housing; means for heating the capillary tube; a plate supported by the housing downstream of the second end of the capillary tube and having an orifice for receiving ions from the second end of the capillary tube; means for producing a first electrical field between the capillary tube and the plate; means for producing a second electrical field downstream of the plate; and a transport tube having an open end supported downstream of the orifice for receiving ions from the orifice, the transport tube being disposed within the second electrical field and discharging ions from the open end of the transport tube. The small transport tube attached to the exit of the capillary tube provides for ion focussing by (a) more efficient electrical field gradients than the prior art, and (b) aerodynamic focussing of the ions. The ions then directly enter the mass spectrometer.

In one embodiment of the present invention, the ion interface incorporates a mechanical valve in communication with the capillary tube for pulsing the flow of ions through the capillary tube. The mechanical valve acts as a mechanical ion gate to independently control the flow of ions from the capillary tube to a mass spectrometer.

An advantage of the ion interface of present invention over the conventional ion interface involves the detachability and simplicity of the interface which consumes only a minimum amount of electric power. There are considerably fewer components to adjust and optimize during the tune-up phase. Additionally, the ion interface can easily be inserted into or removed from the mass spectrometer without compromising the mass analyzer vacuum. Accordingly, the ion interface of the present invention is relatively light, inexpensive, and easily serviceable.

Other features and advantages of the ion interface will become apparent upon reference to the following Description of the Preferred Embodiments when read in light of the attached drawings.

BRIEF DESCRIPTION OF THE DRAWINGS

The present invention will be more clearly understood from the following description in conjunction with the accompanying drawings, wherein:

FIG. 1 is a schematic view of the ion interface according to a first embodiment of the invention;

FIG. 1A is a cross-sectional view of the ion interface along line A—A of FIG. 1;

FIG. 2A illustrates ion trajectories between the ion interface and mass spectrometer without employing an aerodynamic transport tube;

DESCRIPTION OF THE PREFERRED EMBODIMENTS

Figure 2B:
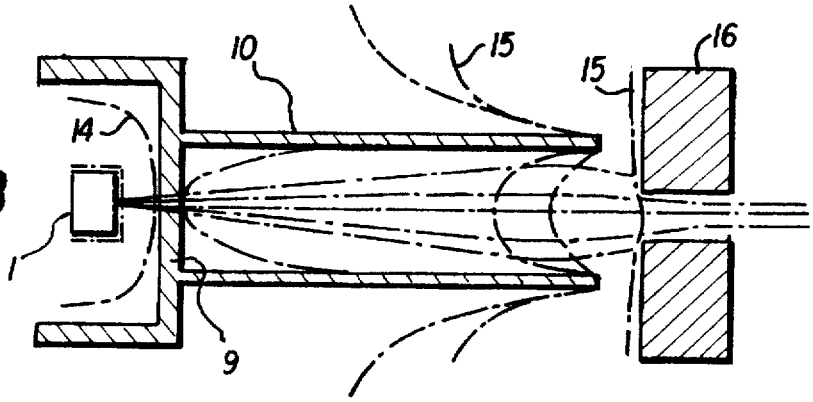
FIG. 2B illustrates ion trajectories between the ion interface and mass spectrometer according to the first embodiment of the invention employing an aerodynamic transport tube.

FIG. 1 shows an ion interface according to a first embodiment of the present invention comprising a capillary tube 1 and a housing tube 2 which are separated, supported, and electrically insulated from one another by a perforated Teflon spacer 3 and Teflon reducing ferrule 4 inserted therebetween. In particular, a heated glass-lined stainless steel tube can be used as the capillary tube 1 which is aligned on the center axis of the housing tube by the perforated Teflon spacer 3 and Teflon reducing ferrule 4 for maximum ion transmission toward an orifice. The housing tube 2 may be formed of stainless steel. FIG. 1A, which is a cross-sectional view of a portion of the ion interface shown in FIG. 1, shows the perforated Teflon spacer 3 having five spherical holes arranged in a circular fashion fitted between the capillary tube 1 and housing tube 2. In FIG. 1, opposite ends of the housing tube 2 are fitted with first and second threaded fittings, $F_1$ and $F_2$, respectively. The capillary tube 1 passes through the first fitting $F_1$ and terminates in the second fitting $F_2$. It is noted that tubes 1 and 2 as well as fittings $F_1$ and $F_2$ are all electrically conductive.

To effectively decluster and desolvate the ions from the electrospray ion source at atmospheric pressure, a portion of the capillary tube 1 is heated. To heat the portion of the capillary tube 1, a Teflon insulated heater wire 6 (e.g., 0.01" OD, OMEGA metal wire) is wrapped around the capillary tube 1 between the Teflon reducing ferrule 4 and the perforated Teflon spacer 3. Additionally, the entrance end of the capillary tube and nitrogen gas inlet 5 near the entrance end of the capillary tube 1 are heated by a heated plate 7 to assist the ion disintegration process and to prevent atmospheric air from entering the mass spectrometer. A temperature gauge 8 in the form of a thermocouple is connected to the capillary tube 1 and measures the temperature of the heated capillary tube 1.

As shown in FIG. 1, a flat metallic plate 9 having a central orifice 9' is mounted in the second fitting $F_2$ adjacent to the exit end of the capillary tube. A transport tube 10, which is connected to the flat plate 9 and centered on the orifice 9' of the flat plate 9, extends outwardly from the second fitting $F_2$. An O-ring 11 inserted between the flat plate 9 and fitting $F_2$ vacuum-seals one end of the housing tube 2. The first fitting $F_1$ affixed at the other end of the housing tube 2 is coupled to the Teflon reducing ferrule 4 which vacuum-seals the other end of the housing tube 2. This arrangement creates a separate vacuum region from that of the mass spectrometer. The housing tube 2 has a low voltage applied to it and directly applies voltage to the flat plate 9 and transport tube 10.

FIG. 1 further shows an electrical feed-through port 12 and roughing vacuum port 13 extending from the housing tube 2. The electrical feed-through port 12 is a leak free connection port whereby at least first, second, and third electrical leads 1', 61, and 8', are fed-through. The first electrical lead 11 is connected to a power supply (not shown) and to the capillary tube 1 for applying a voltage to the capillary tube 1. The second electrical lead 6' is connected to the heater wire 6, and the third electrical lead 8' is connected to the thermocouple 8'. Furthermore, a lead 2' shown in FIG. 1 is connected to a power supply (not shown) and to the housing tube 2 for applying a voltage through the metallic fitting $F_2$ to the metallic plate 9.

The roughing vacuum port 13 is a flange (e.g., ISO NW16) coupled to a pump (not shown) which keeps the pressure inside the housing tube 2 at 1 Torr or less. Additionally, since the total number of ions transmitted through the orifice of the. flat plate 9 is directly proportional to the size of the orifice, the size of the orifice of the flat plate 9 is chosen to be the largest size allowable that will maintain the operating pressure of the mass spectrometer.

As a result of the voltages applied to the capillary tube 1 and the flat plate 9, a first electric field 14, which acts as an electro-gate, is created between the exit end of the capillary tube 1 and the flat plate 9 (see FIGS. 2A and 2B). When the electro-gate is open, that is, the voltage on capillary tube 1 is greater than on the flat plate 9, ions are focused and drawn from the exit end of the capillary tube 1 into the orifice of the flat plate 9. In contrast, when the electro-gate is closed (i.e., reversing the first electric field by lowering the voltage on capillary tube 1 with respect to flat plate 9), ions are defocused and pushed away from the orifice. The first electric field pulses the flow of ions in the capillary tube and thus regulates the ion flow between the capillary tube 1 and the flat plate 9.

FIGS. 2A and 2B show actual ion trajectories in the region between the exit end of the capillary tube 1, through the orifice of the flat plate 9, and into the mass spectrometer entrance 16 in two setups—the ion interface without the transport tube 10 (FIG. 2A), and the ion interface with the transport tube 10 according to the first embodiment of the invention (FIG. 2B). As illustrated by FIGS. 2A and 2B, the transport tube 10 significantly improves ion transmission efficiency in two ways. First, the transport tube 10 improves the focusing effect of a second electrical field 15 formed as a result of the voltage difference between the flat plate 9 and the end-cap of the mass spectrometer 16 by redirecting the second electrical field 15 to the exit end of the transport tube 10 and allowing the cavity at the exit end of the transport tube 10 to change the shape and gradients of the second electrical field 15 to force the ion beam to converge to a focal point close to the center of the mass spectrometer 16. Second, the transport tube 10 prevents ions from diverging into various directions caused by the uncontrolled aerodynamic forces (i.e., expansion of ions in vacuum) while acting as a conduit to contain and transport ions axially toward the center of the mass spectrometer 16. In particular, the aerodynamic forces in the direction perpendicular to the center axis of the ion interface are reduced with the transport tube 10. As a result, instead of rapidly dispersing ions into space (vacuum), the aerodynamic forces disperse ions unidirectionally along the transport tube. Also, the electrical field gradient 15 in FIG. 2B produces more efficient ion focussing than that of FIG. 2A without the transport tube 10.

Figure 3:
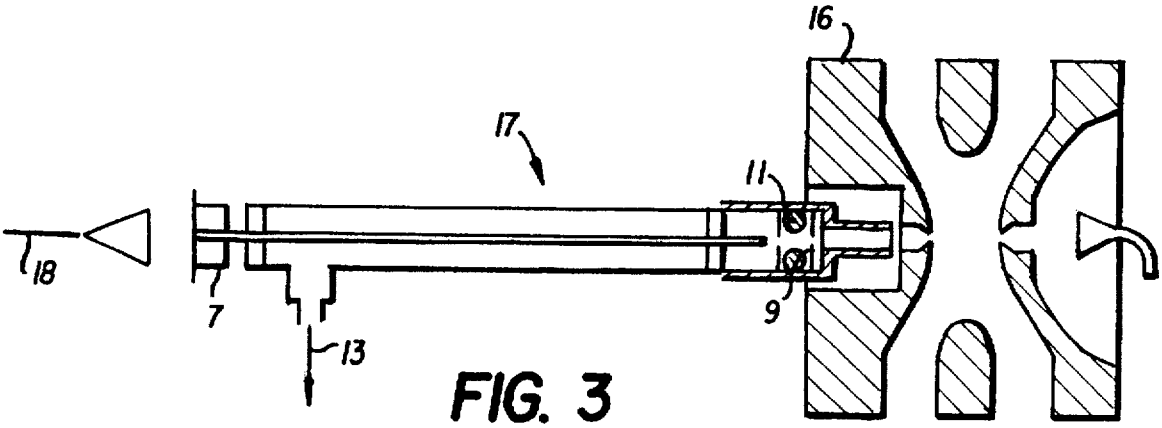
FIG. 3 is a schematic view of the ion interface removably coupled to the mass spectrometer according to the first embodiment of the invention.

FIG. 3 schematically shows a probe-shaped ion interface 17 according to the present invention which is removably coupled to a mass spectrometer 16 (e.g., ITD, Finnigan MAT 700 series). To use the ion interface 17, it is removably inserted into the entrance end of the mass spectrometer 16. In this manner, the ion interface 17 can easily slide in and out of the vacuum gate valve (not shown) of the mass spectrometer 16 without unduly interrupting the operation of the mass spectrometer 16. The mass spectrometer 16, ion interface 17 and the ion source 18 shown in FIG. 3 are at approximately 5 mTorr, 200 mTorr, and 760 Torr (ambient atmospheric pressure), respectively.

Figure 4:
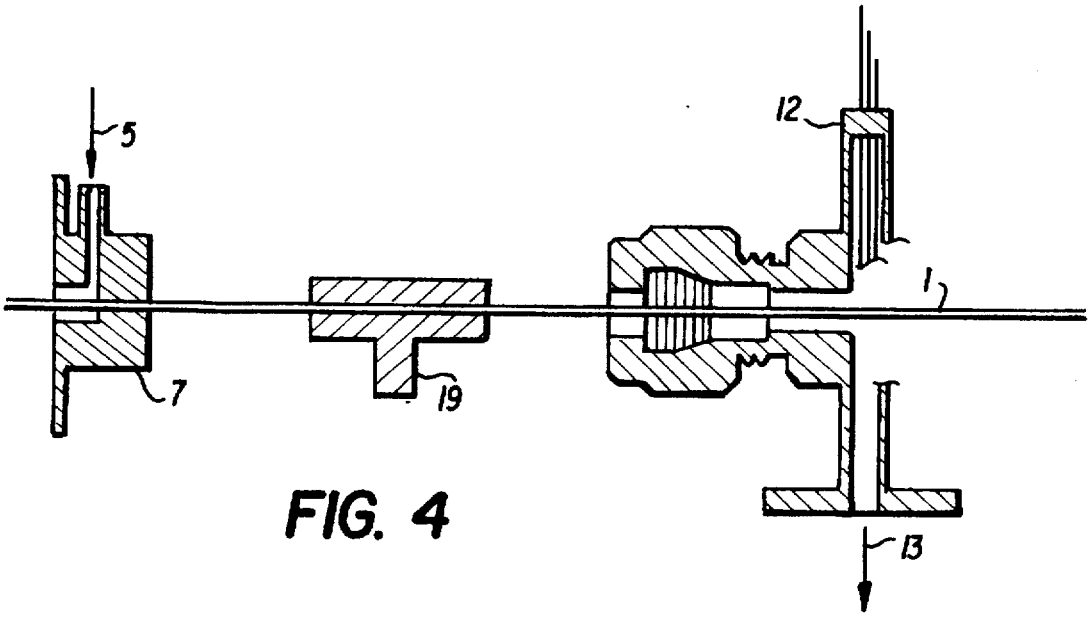
FIG. 4 is a schematic view of a portion of the ion interface according to a second embodiment of the invention.

FIG. 4 illustrates a second embodiment of the ion interface wherein a mechanical valve 19 is connected in communication with the capillary tube 1. The mechanical valve 19 pulses the flow of ions in the capillary tube and acts as a mechanical ion gate to independently control ion flow from the capillary tube 1 to the mass spectrometer 14. Accordingly, both the mechanical valve 19 and first electrical field 14 can independently regulate ion flow between the capillary tube and flat plate. The mechanical valve 19 also provides an additional independent means for preventing any undesirable air molecules in the capillary tube 1 from entering the mass spectrometer 16. Moreover, in instances where the electrogate (i.e., the first electrical field) is intentionally or unintentionally made unavailable, the mechanical valve 19 effectively replaces the first electrical field 14 as the ion gate.

In view of the size and power consumption, the ion interface of the present invention is a convenient and cost-effective alternative to a larger, more costly conventional ion interface. With its low power budget (300 watts) and probe size (1.0×3.0×9.5 in), the ion interface is perfectly suited to operate in either a laboratory or a field environment. The probe 17 can be removed for maintenance or replacement without compromising the vacuum by closing the vacuum gate valve (not shown). Prior art mass spectrometer systems do not have a mass spectrometer that can accept an electrospray device and a gas chromatography inlet on the same flange front end. In the present embodiment, the probe 17 interfaces with the mass spectrometer entrance 16 where the gas chromatography inlet is normally found. Thus, either sample introduction system can be positioned on the mass spectrometer sample introduction entrance without compromising the vacuum in the mass spectrometer.

While the invention has been described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

What is claimed is:

1. An ion interface for a mass spectrometer comprising:

a capillary tube having a first open end for receiving ions and a second open end for discharging ions downstream of the capillary tube;

an airtight housing surrounding a portion of said capillary tube;

supporting means for supporting said capillary tube within said housing;

means for producing a vacuum within said housing;

means for heating said capillary tube;

a plate supported by said housing downstream of said second end of the capillary tube and having an orifice for receiving ions from said second end of the capillary tube;

means for producing a first electrical field between said capillary tube and said plate;

means for producing a second electrical field downstream of said plate; and a transport tube having an open end supported downstream of said orifice for receiving ions from said orifice, said transport tube being disposed within said second electrical field and discharging ions from said open end of the transport tube.

2. The ion interface as defined in claim 1, wherein said first electrical field regulates ion flow between said second end of the capillary tube and said plate.

3. The ion interface as defined in claim 1, wherein said supporting means includes a perforated centering washer disposed within said housing.

4. The ion interface as defined in claim 1, wherein said housing is vacuum-sealed by a reducing ferrule and an 0-ring adjacent to said plate.

5. The ion interface as defined in claim 1, wherein said heating means comprises a metal wire wrapped around a portion of said capillary tube.

6. The ion interface as defined in claim 1, further comprising means for measuring the temperature of said capillary tube.

7. An ion interface for a mass spectrometer comprising:

a capillary tube having a first open end for receiving ions and a second open end for discharging ions downstream of the capillary tube;

airtight housing surrounding a portion of said capillary tube;

supporting means for supporting said capillary tube within said housing;

means for producing a vacuum within said housing;

means for heating said capillary tube;

a plate supported by said housing downstream of said second end of the capillary tube and having an orifice for receiving ions from said second end of the capillary tube;

a mechanical valve for pulsing the flow of ions through said capillary tube;

means for producing an electrical field downstream of said plate; and a transport tube having an open end supported downstream of said orifice for receiving ions from said orifice, said transport tube being disposed within said electrical field and discharging ions from said open end of the transport tube.

8. The ion interface as defined in claim 7, wherein said mechanical valve regulates ion flow between said second end of the capillary tube and said plate.

9. The ion interface as defined in claim 7, wherein said supporting means includes a perforated centering washer disposed within said housing.

10. The ion interface as defined in claim 7, wherein said housing is vacuum-sealed by a reducing ferrule and an O-ring adjacent to said plate.

11. The ion interface as defined in claim 7, wherein said heating means comprises a metal wire wrapped around a portion of said capillary tube.

12. The ion interface as defined in claim 7, further comprising means for measuring the temperature of said capillary tube.

13. An ion interface for a mass spectrometer comprising:

a capillary tube having a first open end for receiving ions and a second open end for discharging ions downstream of the capillary tube;

an airtight housing surrounding a portion of said capillary tube;

supporting means for supporting said capillary tube within said housing;

means for producing a vacuum within said housing;

means for heating said capillary tube;

a plate supported by said housing downstream of said second end of the capillary tube and having an orifice for receiving ions from said second end of the capillary tube;

means for producing a first electrical field between said capillary tube and said plate;

means for producing a second electrical field downstream of said plate;

a mechanical valve for pulsing the flow of ions through said capillary tube; and a transport tube having an open end supported downstream of said orifice for receiving ions from said orifice, said transport tube being disposed within said second electrical field and discharging ions from said open end of the transport tube.

14. The ion interface as defined in claim 13, wherein said first electrical field and said mechanical valve both regulate ion flow between said second end of the capillary tube and said plate.

15. The ion interface as defined in claim 13, wherein said supporting means includes a perforated centering washer disposed within said housing.

16. The ion interface as defined in claim 13, wherein said housing is vacuum-sealed by a reducing ferrule and an O-ring adjacent to said plate.

17. The ion interface as defined in claim 13, wherein said heating means comprises a metal wire wrapped around a portion of said capillary tube.

18. The ion interface as defined in claim 13, further comprising means for measuring the temperature of said capillary tube.

* * * * *